US006883341B1

(12) United States Patent
Lifson

(10) Patent No.: US 6,883,341 B1
(45) Date of Patent: Apr. 26, 2005

(54) COMPRESSOR WITH UNLOADER VALVE BETWEEN ECONOMIZER LINE AND EVAPORATOR INLET

(75) Inventor: Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 23 days.

(21) Appl. No.: 10/705,319

(22) Filed: Nov. 10, 2003

(51) Int. Cl.[7] ..... F25B 41/00; F25B 49/00

(52) U.S. Cl. ..... 62/196.4; 62/200; 62/225; 62/510; 62/513; 418/60

(58) Field of Search ..... 62/196.4, 196.1, 62/196.3, 197, 513, 113, 117, 200, 225, 505, 62/510; 417/286, 426; 418/55.1, 60

(56) References Cited

U.S. PATENT DOCUMENTS 5,996,364 A 12/1999 Lifson
6,058,729 A * 5/2000 Lifson et al. ..... 62/217
6,138,467 A * 10/2000 Lifson et al. ..... 62/217
6,385,981 B1 * 5/2002 Vaisman ..... 62/196.3
6,428,284 B1 * 8/2002 Vaisman ..... 417/213
6,571,576 B1 * 6/2003 Lifson et al. ..... 62/513

* cited by examiner

*Primary Examiner*—Marc Norman
(74) *Attorney, Agent, or Firm*—Carlson, Gaskey & Olds

(57) ABSTRACT

A compressor has an economizer injection line communicating into the compressor compression chambers. An unloader valve selectively communicates the economizer injection line back to a point upstream of the evaporator. When the compressor is run in unloaded mode, partially compressed refrigerant is thus returned to a point upstream of the evaporator. In unloaded mode, this results in a higher refrigerant mass flow through the evaporator, as compared to prior art where the bypassed refrigerant was returned downstream of the evaporator. This increases system efficiency by more effectively returning oil which otherwise might be left in the evaporator back to the compressor. Also, the amount of refrigerant superheat entering the compressor in unloaded operation is reduced as compared to the prior art compressor systems, wherein the bypassed refrigerant is returned directly to the compressor suction line. Reduced refrigerant superheat increases system efficiency, improves motor performance and reduces compressor discharge temperature.

10 Claims, 3 Drawing Sheets

COMPRESSOR WITH UNLOADER VALVE BETWEEN ECONOMIZER LINE AND EVAPORATOR INLET

BACKGROUND OF THE INVENTION

This invention relates to a unique placement for an unloader valve that is particularly beneficial to a compressor that operates in economized cycle and can also be unloaded through an intermediate economizer port.

One of the compressor types that are especially suited for this invention is a scroll compressor. Scroll compressors are becoming widely utilized in compression applications. However, scroll compressors present several design challenges. One particular design challenge is achieving reduced capacity levels when full capacity operation is not desired.

Thus, scroll compressors, as an example, have been provided with unloader bypass valves that divert a portion of the compressed refrigerant back to a compressor suction port. In this way, the mass of refrigerant being compressed is reduced. Of course, other compressor types may also have a bypass valve for similar purpose.

On the other hand, in many refrigerant compression applications, there are other times when it would be more desirable to have the ability to also achieve increased unit capacity. One way of achieving increased capacity is the inclusion of an economizer circuit into the refrigerant system. An economizer circuit essentially provides heat transfer between a main refrigerant flow downstream of the condenser, and a second refrigerant flow which is also tapped downstream of the condenser and passed through an expansion valve. The main flow is cooled in a heat exchanger by the second flow. In this way, the main flow from the condenser is cooled before passing through its own expansion valve and entering the evaporator. Since the main flow enters the expansion valve at a cooler temperature, it has greater capacity to absorb heat, and provides increased system cooling capacity, which was the original objective. The refrigerant in the second flow preferably enters the compression chambers at an intermediate compression point, slightly downstream of suction. Typically, the economizer fluid is injected at a point after the compression chambers have been closed.

In a system disclosed in U.S. Pat. No. 5,996,364, a refrigerant system has both a bypass line and an economizer circuit. The bypass line communicates the vapor from intermediate compression point directly to the suction line. This bypass line is provided with the unloader valve. When it is desired to have unloaded operation, the unloader valve is opened, and the economizer valve is closed. Refrigerant may thus then be returned from an intermediate point in the compression cycle directly back to suction.

While this prior art system has achieved many benefits, there are certain additional refinements that would be beneficial.

SUMMARY OF THE INVENTION

In a disclosed embodiment of this invention, a compressor is provided with an economizer circuit, and a bypass line. An unloader valve is positioned on the bypass line and is operable to selectively communicate the refrigerant from intermediate compression point to the point upstream of the evaporator. A valve on the economizer injection line may be closed and the unloader valve opened; then the economizer injection ports in the compressor serve as bypass ports and tap fluid back to the point upstream of the evaporator.

The present invention provides several benefits over the prior art that returns refrigerant from an intermediate compression point directly to the suction line. In this invention, the refrigerant from the intermediate compression point is returned upstream of the evaporator (preferably at the location between the main expansion valve and the evaporator entrance) instead of being returned downstream of the evaporator (at a location between the evaporator exit and compressor suction port). This results in a greater refrigerant mass flow through the evaporator during unloaded operation over the prior art. Increased refrigerant mass flow improves return flow of oil to the compressor during unloaded operation, increasing the efficiency of the evaporator. Improved oil return also minimizes a risk of pumping the oil out of the compressor shell and storing it in the evaporator. If the oil is pumped out from the compressor, then the compressor could be damaged because bearings and the pump set may not receive adequate lubrication.

Further, as is known, a sensor is typically provided downstream of the evaporator to control an amount of opening of the main expansion device. The main expansion device is controlled to have the desired opening to maintain a required superheat of the refrigerant leaving the evaporator.

In another feature, the prior art had an unloader bypass valve just outside the compressor. As such, the valve and associated piping, etc. was often in the way should it become necessary to replace the compressor. By moving the bypass line and the unloader bypass valve away from the compressor, more space surrounding the compressor is created, which simplifies the compressor replacement.

The present invention thus provides valuable benefits.

These and other features of the present invention can be best understood from the following specification and drawings, the following of which is a brief description.

DETAILED DESCRIPTION OF THE PREFERRED EMBODIMENT

Figure 1:
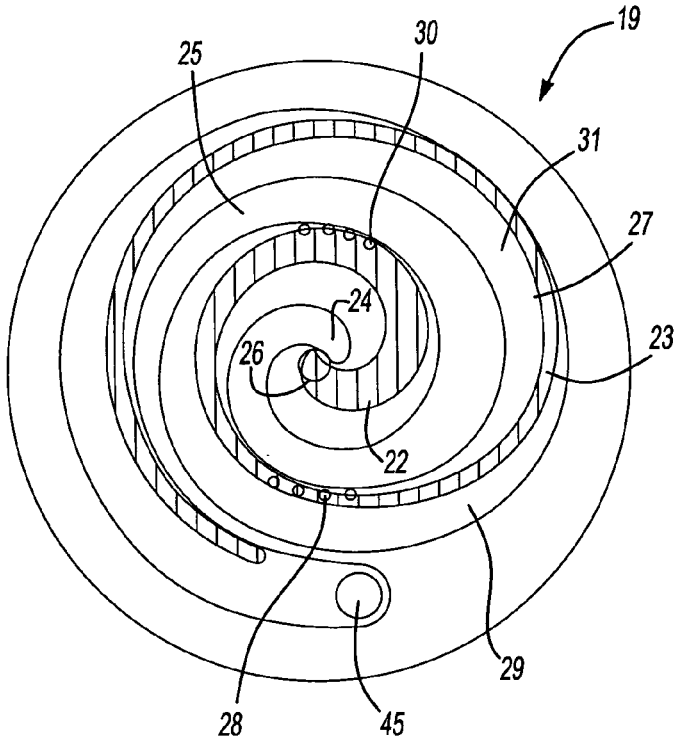
Fig-1 PRIOR ART
FIG. 1 shows a prior art scroll compressor.

As an example of a compressor type suitable for this invention, a prior art scroll compressor pump set 19 is illustrated in FIG. 1 having an orbiting scroll element 22 which includes an orbiting scroll wrap 23 and a fixed, or non-orbiting, scroll element 24 which includes a non-orbiting scroll wrap 25. The scroll wraps interfit and surround discharge port 26. As known, the orbiting scroll element 22 orbits relative to the non-orbiting scroll element 24 and the scroll wraps 23 and 25 selectively trap pockets of refrigerant which are compressed towards discharge port 26. A plurality of ports 28 and 30 are formed in the base 31 of the non-orbiting scroll element 24. Alternately, ports 28 and 30 may consist of a pair of single, larger ports. The ports may also extend through the wraps 23, 25 or be in other locations.

In the position shown in FIG. 1, ports 28 and 30 are just being uncovered by the orbiting scroll wrap 23 at about the same time as compression chambers 27 and 29 are being sealed from a zone that communicates with suction line 45.

Figure 2:
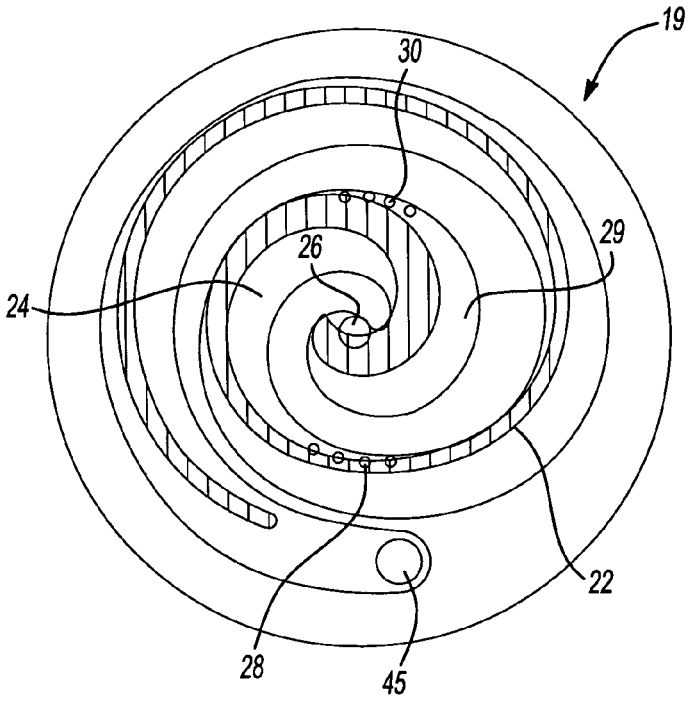
Fig-2 PRIOR ART
FIG. 2 shows a prior art scroll compressor at a slightly different operational state.

As shown in Prior Art FIG. 2, with continued movement of the orbiting scroll wrap, ports 28 and 30 are uncovered and are exposed to compression chambers 27 and 29 which have been closed by the movement of the orbiting scroll wrap 23 to contact the non-orbiting scroll wrap 25.

Figure 3:
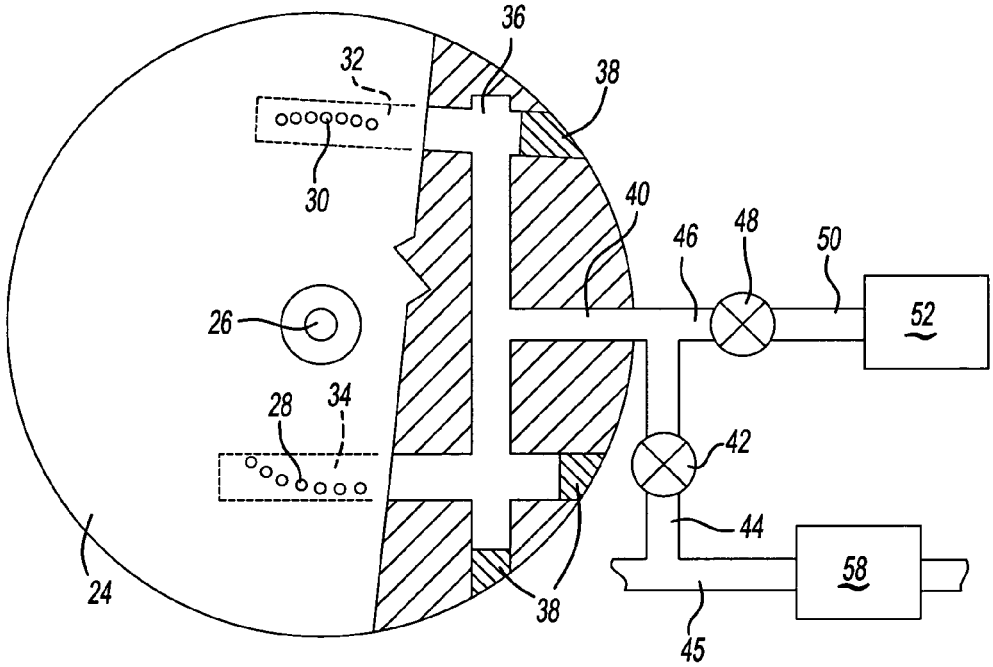
Fig-3 PRIOR ART
FIG. 3 shows how a prior art non-orbiting scroll of a scroll compressor is connected to adjacent piping.

As shown in prior art FIG. 3, a first passage 32 communicates with ports 30 and a second passage 34 communicates with ports 28. A crossing passage 36 communicates between passages 32 and 34. A series of plugs 38 close the passages 32, 34 and 36 as appropriate. A passage 40 communicates crossing passage 36 to a bypass valve 42 which leads to a line 44 leading back to a suction line 45 and to a passage 46 which leads to an economizer valve 48 which communicates with an economizer injection line 50 and is communicates to an economizer heat exchanger 52 or economizer flash tank. Other arrangements to route the refrigerant flow from intermediate compression pockets to a passage 46 are also possible as known in the art.

Figure 4:
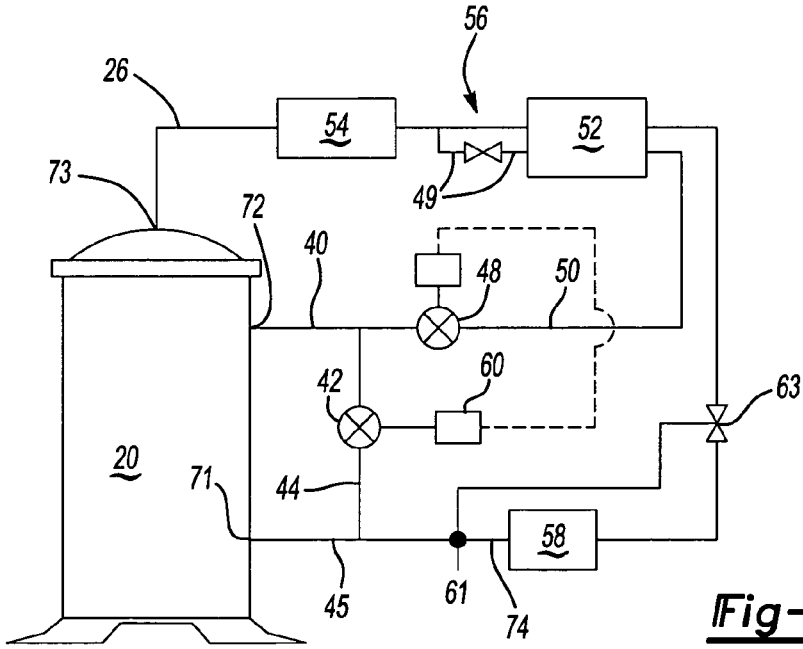
Fig-4 PRIOR ART
FIG. 4 is a schematic view of a prior art refrigerant cycle.

As shown in Prior Art FIG. 4, there is a compressor 20 that has a suction port 71, an intermediate port 72 and a discharge port 73. A line 40 establishes a communication between intermediate compression point and either an economizer heat exchanger 52 through line 50 or suction line 45 through line 44. The economizer heat exchanger 52 is positioned just downstream of the condenser 54 of a refrigerant system 56. Alternatively, economizer valve 48 may be positioned in line 49 just upstream of the economizer heat exchanger 52.

As shown, a sensor 61 senses the condition of the refrigerant downstream of the evaporator 58 in line 74 and communicates with a main expansion device 63. It should be noted that a sensor 61 can, for example, be a feeler bulb of thermostatic expansion valve (TXV) or a temperature sensor of electronic expansion valve (EXV) or a specialized thermistor of electric expansion valve that senses the presence of liquid in the stream. However, regardless of the type of the sensor or expansion device type, the purpose of the sensor is to control the amount of main expansion device opening to achieve a desired amount of expansion of the refrigerant approaching the evaporator 58 such that the refrigerant leaving the evaporator 58 has a desired superheat amount upon entering compressor suction port 71. However, during unloaded operation, bypass line 44 returns relatively hot refrigerant to the suction line 45 downstream of the sensor 61. The sensor 61 is thus not achieving the desired superheat of the refrigerant returning through suction line 45 to the suction inlet port 71 of the compressor 20 when the compressor is operating in bypass mode. That is, the sensor 61 would not be aware of the increase in the refrigerant temperature in line 45 due to the returned hot refrigerant from the bypass line 44 being mixed with refrigerant from line 74, and would thus not achieve the desired superheat of the refrigerant entering the compressor through port 71.

During operation of the prior art refrigerant systems, three levels of capacity may be achieved. First, under full capacity the economizer valve 48 is opened, bypass valve 42 is closed, and economized operation occurs. As known generally in the art, this increases the capacity of the refrigerant system by improving the thermodynamic state of the fluid approaching the evaporator 58.

When a lower capacity is desired, then both valves 48 and 42 may be closed. In such operation, the compressor operates with economized cycle turned off and without bypass. A control 60 operates the system 56, including valves 48 and 42.

Finally, when an even lower capacity level is desired, the economizer valve 48 is closed and bypass valve 42 is opened. Now, fluid which has been trapped within the compression chambers passes outwardly through the intermediate port 72 and line 40, 44 and into suction line 45. The fluid is thus bypassed back to the inlet of scroll compressor 20 through port 71.

Preferably, the bypass path 44 and valve 42 are positioned outwardly of the scroll compressor housing, thus simplifying the control arrangements of valve 42 and the assembly of the scroll compressor. However, the bypass path 44 and valve 42 may be within the housing.

In general, the prior art system configuration of FIG. 4 achieves benefits by utilizing a single set of ports and passages to achieve both economized and bypass operation.

Figure 5:
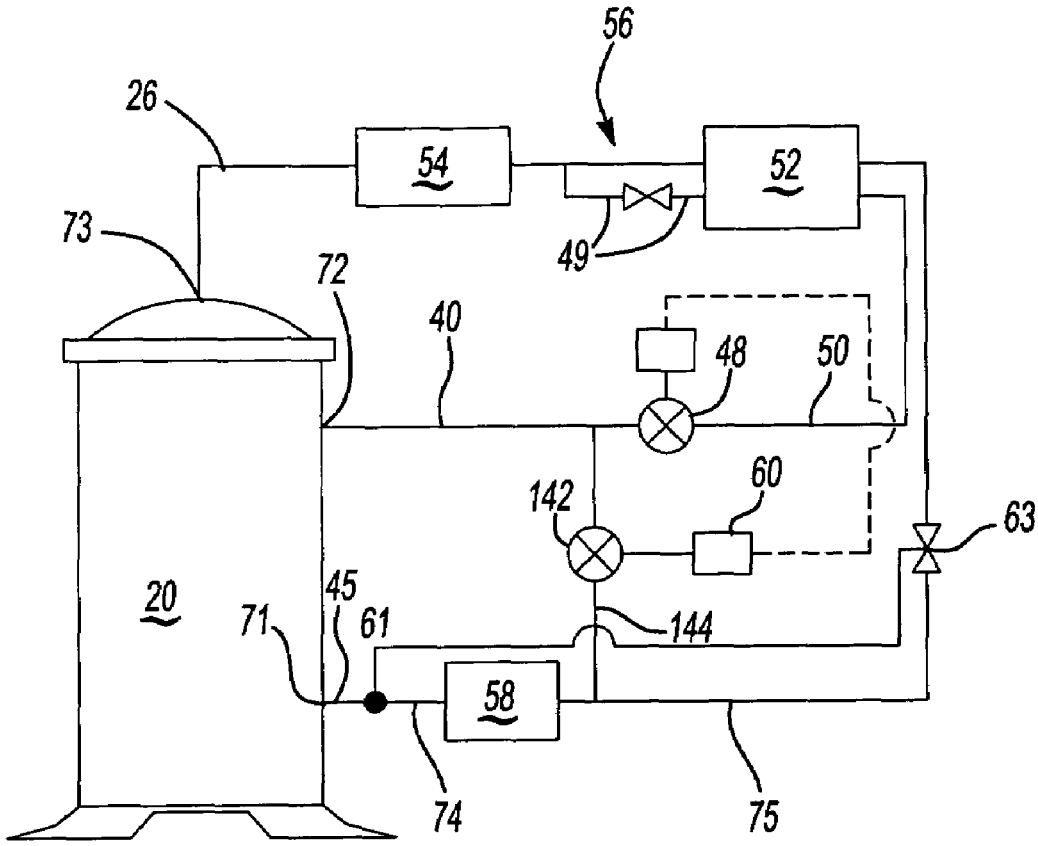
FIG. 5 shows the inventive refrigerant cycle.

FIG. 5 shows the inventive system. Components having the same general configuration and location are labeled by the same number as in FIG. 4. Internal passages similar to those of FIGS. 1 and 2 may be included. As can be seen, the bypass line 144 and the unloader valve 142 are now positioned such that refrigerant is returned through the bypass line 144 upstream of the evaporator 58. The unloaded operation and the economizer operation would be exactly as described above, with regard to the opening and closing of the valves. However, when the refrigerant is returned through the bypass line 144 in unloaded mode, this refrigerant will mix with the main flow in line 75 traveling to the evaporator 58. The temperature sensor 161 that is still positioned downstream of the evaporator 58, will now sense the combined effect of both the bypassed refrigerant from line 144 and the main refrigerant flow. However, now the sensor will control the amount of and entering the compressor through suction port 71. Further, there is a greater mass flow of refrigerant through the evaporator 58 in unloaded mode of operation than in the prior art system. This will provide a greater oil return through the suction line 45 to the compressor 20. With the mass flow of refrigerant being increased, it is easier to return the oil back to the compressor. The improved oil return also improves heat transfer capability of the evaporator since less oil remains on the heat transfer surfaces of the evaporator. The improved oil return to the compressor also minimizes a possibility of oil completely leaving the compressor, thus, preventing potential compressor damage due to lack of lubrication.

Further, in the prior art, wherein the bypass line and bypass valve were positioned adjacent to the compressor to communicate the bypassed refrigerant to the suction line, the compressor replacement was cumbersome. The present invention, by moving the bypass line and bypass valve to a location further away from the compressor, simplifies the compressor replacement.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A refrigerant cycle:

a compressor;

said compressor having an outlet providing a refrigerant to a condenser, said condenser providing refrigerant to a main expansion device, refrigerant moving from said main expansion device to an evaporator, and a compressor suction inlet downstream of said evaporator;

at least one economizer injection port communicating with said compressor at a location downstream of said suction inlet; and an unloader valve for selectively communicating a compressed refrigerant from said compressor through said economizer injection port to a point upstream of said evaporator.

2. A refrigerant cycle as recited in claim 1, wherein said compressor is a scroll compressor.

3. A refrigerant cycle as recited in claim 1, wherein said unloader valve is positioned in a bypass passage mounted outwardly of a compressor housing.

4. A refrigerant cycle as recited in claim 1, wherein a sensor is positioned downstream of said evaporator, and upstream of said suction inlet to said compressor, said sensor controlling said main expansion device to achieve a desired amount of superheat at an outlet of said evaporator.

5. A refrigerant cycle as recited in claim 1, wherein an economizer circuit supplies refrigerant to said economizer injection port, and an economizer valve disposed upstream of a point where said unloader valve communicates with said economizer injection port, said economizer valve being shut when said unloader valve is opened.

6. A refrigerant cycle comprising:

a scroll compressor pump unit having an orbiting scroll with a base and a scroll wrap extending from said base, a non-orbiting scroll having a base and a scroll wrap extending from said base and interfitting with said orbiting scroll wrap to define compression chambers;

at least one economizer injection port passing into said compression chambers, said economizer injection port communicating with an economizer injection passage, which is connected to an economizer circuit;

said compressor pump unit having an outlet providing a refrigerant to a condenser, said condenser providing refrigerant to a main expansion device, and said refrigerant moving from said main expansion device to an evaporator, and a suction inlet being provided back to said compressor downstream of said evaporator; and an unloader system selectively communicating said economizer injection passage to a point upstream of said evaporator, said unloader system including a bypass line communicating said economizer injection passage to said point upstream of said evaporator and an unloader valve selectively opening said bypass line, compressed refrigerant from said compression chambers passing through said economizer injection passage and to said point upstream of said evaporator when said unloader valve is open.

7. A refrigerant cycle as recited in claim 6, wherein an economizer valve is placed on said economizer injection passage, upstream of said bypass line.

8. A refrigerant cycle as recited in claim 7, wherein said economizer valve is shut when said unloader valve is open.

9. A refrigerant cycle as recited in claim 6, wherein said economizer valve is positioned in a bypass passage mounted outwardly of a compressor housing.

10. A refrigerant cycle as recited in claim 6, wherein a sensor is positioned downstream of said evaporator, and upstream of said suction inlet to said compressor, said sensor controlling said main expansion device to achieve a desired amount of superheat on an outlet of said evaporator.

* * * * *